US010378534B2

(12) United States Patent
Cole

(10) Patent No.: US 10,378,534 B2
(45) Date of Patent: Aug. 13, 2019

(54) METHOD OF BYPASSING A FLOAT SWITCH CONTROLLING A WATER PUMP

(71) Applicant: Derrick Cole, St. Croix, VI (US)

(72) Inventor: Derrick Cole, St. Croix, VI (US)

( * ) Notice: Subject to any disclaimer, the term of this patent is extended or adjusted under 35 U.S.C. 154(b) by 0 days.

(21) Appl. No.: 15/346,769

(22) Filed: Nov. 9, 2016

(65) Prior Publication Data

US 2018/0128265 A1 May 10, 2018

(51) Int. Cl.

| | |
|---|---|
| ***F04B 49/04*** | (2006.01) |
| ***F04B 49/025*** | (2006.01) |
| ***F04B 49/02*** | (2006.01) |
| ***F04B 23/02*** | (2006.01) |
| ***F04B 49/08*** | (2006.01) |

(52) U.S. Cl.

CPC ..... *F04B 49/02* (2013.01); *F04B 23/025* (2013.01); *F04B 49/025* (2013.01); *F04B 49/04* (2013.01); *F04B 49/08* (2013.01); *F04B 2205/05* (2013.01)

(58) Field of Classification Search

CPC ..... F04B 49/025; F04B 49/022; F04B 49/04; F04B 49/08; F04B 2205/05

USPC ..... 417/40, 41

See application file for complete search history.

(56) References Cited

U.S. PATENT DOCUMENTS 2,625,107 A * 1/1953 Schaefer ..... F04D 13/086 310/87
2,804,019 A * 8/1957 Schaefer ..... F04D 15/0218 200/81 R
2,888,875 A * 6/1959 Buck ..... E03B 5/02 200/83 R
3,173,476 A * 3/1965 McCready ..... F25B 13/00 165/232
3,316,845 A * 5/1967 Schumann ..... F04D 15/0218 417/40
3,801,889 A * 4/1974 Quinn ..... G05D 16/2066 318/481
4,212,889 A * 7/1980 Fuentevilla ..... A23L 17/65 137/575
4,329,120 A * 5/1982 Walters ..... F04B 49/022 417/12
4,444,545 A * 4/1984 Sanders ..... F04B 49/025 307/118
5,015,152 A * 5/1991 Greene ..... F04B 49/04 417/40
5,281,858 A * 1/1994 Langved ..... H01H 35/18 200/84 R
6,203,281 B1 * 3/2001 Gurega ..... F04B 49/025 417/40

(Continued)

*Primary Examiner* — Christopher S Bobish
(74) *Attorney, Agent, or Firm* — Tiffany C. Miller; Inventions International Inc.

(57) ABSTRACT

A method for bypassing a float switch controlling a water pump having the steps of providing a water pump having a discharge port. The water pump is hydraulically connected to a water supply. The water supply has a float switch electrically connected to a pressure switch. The pressure switch is hydraulically connected to a discharge port of the water pump. The pressure switch is electrically connected to a manually operated switch. The float switch opens an electrical circuit to the water pump when the float switch senses a low water supply. The manually operated switch manually closes the electrical circuit to the water pump when the float switch has an open circuit which causes the water pump to operate when the supply water level is low.

1 Claim, 1 Drawing Sheet

(56) References Cited

U.S. PATENT DOCUMENTS

| | | | | |
|---|---|---|---|---|
| 6,490,986 | B1 * | 12/2002 | Sherdel | B63B 17/00 114/183 R |
| 2003/0091440 | A1 * | 5/2003 | Patel | F04B 39/121 417/12 |
| 2006/0269426 | A1 * | 11/2006 | Llewellyn | B63B 13/00 417/411 |
| 2007/0177985 | A1 * | 8/2007 | Walls | F04B 43/0081 417/44.2 |
| 2009/0050042 | A1 * | 2/2009 | Waldecker | G08B 21/20 114/183 R |
| 2010/0002342 | A1 * | 1/2010 | Carlson | F04B 49/02 361/31 |
| 2014/0328696 | A1 * | 11/2014 | Bishop | F04B 49/02 417/53 |

* cited by examiner

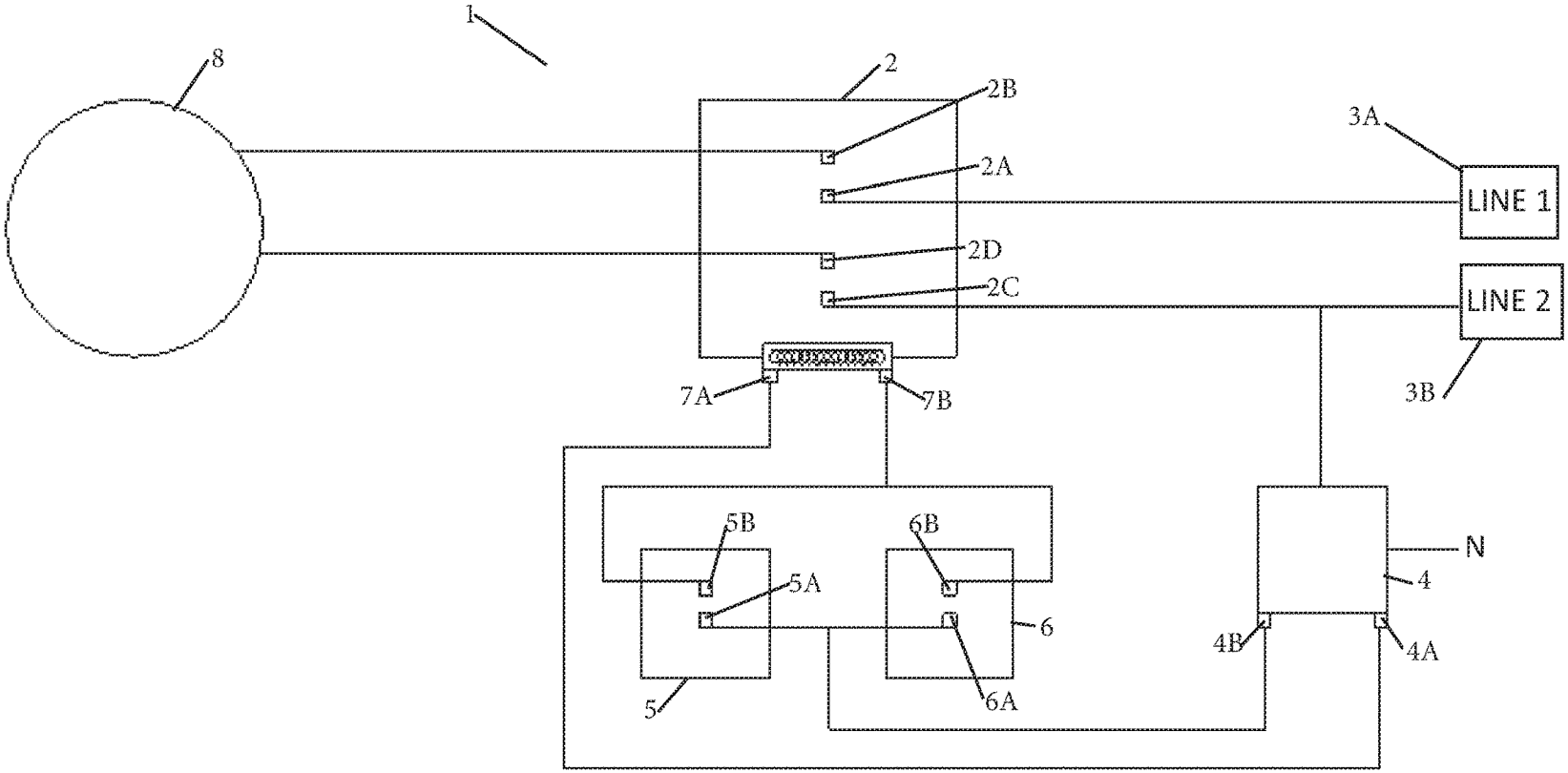
LINE 1
LINE 2
3A
3B
N
4
4A
4B
2
2B
2A
2D
2C
7B
7A
6
6A
6B
5A
5B
5
1
8

METHOD OF BYPASSING A FLOAT SWITCH CONTROLLING A WATER PUMP

BACKGROUND OF THE INVENTION

1. Field of the Invention

This invention relates, generally, to a method of bypassing a float switch controlling a water pump. More particularly, it relates to a water pump hydraulically connected to a reservoir and to a pressure switch.

2. Background Art

Currently, a pressure float in a water reservoir detects a low water level and sends an electrical signal to a pressure sensitive relay switch which causes the pressure sensitive relay switch to open the power supply circuit to the water pump. This results in the water pump turning off. There may still be water at the bottom of the water reservoir that can be desirable for a user to access. There is a need for a manual override switch to allow a user to use the remaining water in the water reservoir. Additionally, this manual switch is helpful in priming the pump during the servicing of the pump such as, replacing of the shaft seal or pump motor.

Commonly, float switches do not sense accurately. These inefficient float switches often turn off the water pump before the water is exhausted and leave usable water in the reservoir. This novel invention allows a user to manually access or extract at least apportion of water from the reservoir.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a method for bypassing a float switch controlling a water pump, allowing a user to manually switch the water pump back on to access the remaining water in the water reservoir, and which also includes improvements that overcome the limitations of prior art methods of extracting water from a reservoir is now met by a new, useful, and non-obvious invention.

The novel method for bypassing a float switch controlling a water pump includes the steps of providing a water pump having a discharge port, whereby, the water pump is hydraulically connected to a water supply. The water supply has a float switch electrically connected to a pressure switch. The pressure switch is hydraulically connected to a discharge port of the water pump. The pressure switch is electrically connected to a manually operated switch. The float switch is configured to open an electrical circuit to the water pump when the float switch senses a low water supply. The manually operated switch is configured to manually close the electrical circuit to the water pump when the float switch is in an open circuit configuration causing the water pump to operate when the supply water level is low.

In an alternate embodiment, the method of bypassing a float switch controlling a water pump further includes the steps of the pressure switch being configured to open the closed circuit when a predetermined pressure is sensed from the discharge port of the water pump.

BRIEF DESCRIPTION OF THE DRAWINGS

For a fuller understanding of the nature and objects of the invention, reference should be made to the following detailed description, taken in connection with the accompanying diagram, in which:

FIG. 1 is a wiring diagram of the novel circuitry containing an electrical circuit for bypassing a float switch controlling a water pump.

DETAILED DESCRIPTION OF THE PREFERRED EMBODIMENT

In the following detailed description of the preferred embodiments, reference is made to the accompanying wiring diagram, which forms a part hereof, and within which is shown by way of illustration specific embodiments by which the invention may be practiced. It is to be understood that other embodiments may be utilized and structural changes may be made without departing from the scope of the invention.

In a general embodiment the pressure switch is an electric coil actuated relay with a pressure sensitive override. When electrical power is applied to the coil, the coil magnetically engages the contact switch. This coil actuates the switch or relay inside the pressure switch. When the coil is energized, it closes the switch. The coil needs power and neutral to actuate it. The coil can be energized or actuated from either the float switch or from the manually operated switch to actuate the coil.

In a preferred embodiment, the manually operated switch can apply electrical current directly to the motor, thereby, bypassing the pressure switch. It is within the scope of this current invention for the manually operated switch to apply electrical current to the pressure switch, whereby, the pressure switch can still disengage the water pump motor when a predetermined pressure is reached.

It will now be seen, referring to FIG. 1, the novel circuitry 1 includes pressure switch 2 having pressure switch electrical contacts 2A, 2B, 2C, and 2D. Pressure switch 2 has coil 7A and 7B. Electrical contact 2A of pressure switch 2 is electrically connected with line power 3A. Electrical contact 2B of pressure switch 2 is electrically connected with motor 8. Manually operated switch 5 has electrical contacts 5A and 5B. Float switch 6 has electrical contacts 6A and 6B. Electrical contact 5A of manually operated switch 5 is electrically connected to electrical contact 6A of float switch 6.

Line power 3B energizes low voltage transformer 4. Low voltage transformer 4 has leads 4A and 4B. Low voltage transformer 4 reduces high voltage line power to low voltage control power. Lead 4A of low voltage transformer 4 is electrically connected to one side of coil 7A. Lead 4B of low voltage transformer 4 is electrically connected to electrical contact 5A of manually operated switch 5 and electrical contact 6A of float switch 6.

Electrical contact 6B of Float switch 6 is electrically connected with coil 7B of pressure switch 2. Electrical contact 5B of manually operated switch 5 is electrically connected with coil 7B of pressure switch 2. Electrical contact 2B of pressure switch 2 is electrically connected with motor 8. Electrical contact 2C is electrically connected with line power 3B.

It is within the scope of this invention for the pressure switch 2 to be mounted on a water pump housing, a reservoir tank, or any portion of the discharge plumbing of the water pump.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying diagram shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A method of bypassing a float switch controlling a water pump, comprising the steps of:

providing a water pump having a discharge port, said water pump is hydraulically connected to a water supply, said water supply having a float switch electrically connected to a pressure switch, said pressure switch is an electric coil actuated relay with a pressure sensitive override, said electric coil actuated relay having first and second coils, said pressure switch having a contact switch, said coils magnetically engage said contact switch when electrical power is applied to said coils, whereby, said pressure switch is hydraulically connected to said discharge port of said water pump;

providing a transformer having a first lead and a second lead, said first coil of said pressure switch is electrically connected to said first lead of said transformer;

providing a manually operated switch having a first electrical contact and a second electrical contact, said float switch has a first electrical contact and a second electrical contact, said first electrical contact of said float switch is electrically connected to both said first electrical contact of said manually operated switch and said second lead of said transformer, said second coil of said pressure switch is electrically connected to both said second electrical contact of said manually operated switch and to said second electrical contact of said float switch, said float switch is configured to open an electrical circuit to said water pump when said float switch senses a low water supply, said manually operated switch is configured to manually close said electrical circuit to said water pump when said float switch is in an open circuit configuration causing said water pump to operate when supply water level is low, whereby, said pressure switch remains operative when said manually operated switch bypasses said float switch.

* * * * *